United States Patent [19]

Wuthrich

[11] 4,249,251

[45] Feb. 3, 1981

[54] GEAR TRAIN FOR TIMEPIECE WITH A STEPPING MOTOR

[75] Inventor: Paul Wuthrich, Watertown, Conn.

[73] Assignee: Timex Corporation, Middlebury, Conn.

[21] Appl. No.: 88,920

[22] Filed: Oct. 29, 1979

[51] Int. Cl.[3] ..... G04B 19/00; G04B 29/00

[52] U.S. Cl. ..... 368/76; 368/220; 368/322

[58] Field of Search ..... 58/7, 23 R, 23 D, 59, 58/104, 140 R, 140 A, 140 B; 368/62, 76, 220, 322, 324

[56] References Cited

U.S. PATENT DOCUMENTS

| | | | |
|---|---|---|---|
| 3,552,115 | 1/1971 | Losert | 58/39.5 |
| 4,079,582 | 3/1978 | Tamaru et al. | 58/23 D |
| 4,086,753 | 5/1978 | Tsuchiya et al. | 58/23 D |

*Primary Examiner*—Vit W. Miska

*Attorney, Agent, or Firm*—William C. Crutcher

[57] ABSTRACT

A stepping motor driven by a time-based electrical driving signal periodically rotates an overhung gear train directly driving the hour and minute hands mounted on a main arbor. The arbor is rotatably mounted in two spaced journals in a single tapered bearing hole in the frame. An intermediate arbor is similarly journaled. The gear train is assembled from only one side of the timepiece. The main arbor, center gear assembly, hands and dial are all added as a subassembly.

5 Claims, 2 Drawing Figures

GEAR TRAIN FOR TIMEPIECE WITH A STEPPING MOTOR

BACKGROUND OF THE INVENTION

This invention relates generally to an improved gear train for a timepiece with an electric stepping motor. More particularly, the invention relates to an overhung gear train assembled from one side of the watch frame and having improvements in the arrangement of wheels and the journal bearing supports.

Electronic timepieces of the "analog" type, i.e., having conventional rotating hands have been developed wherein a stepping motor is accurately driven from a time based electrical driving signal. The driving signal may come from a transistor pulse-producing circuit, or more recently, from an integrated circuit having a quartz oscillator time base.

Since a stepping motor may be rotatably advanced at any desired pulse frequency, this leads to opportunities in reducing the number of components in the conventional gear train from those in a continuous rotating synchronous driving motor. An example of a quartz oscillator controlled stepping motor driven periodically by pulses and directly geared to the sweep seconds wheel on the main arbor is shown in U.S. Pat. No. 3,824,781 in the name of G. Diersbock issued July 23, 1974 and assigned to the present assignee. Placement of a gear train on "overhung" arbors, defined herein as arbors journaled on only one end, as opposed to being journaled on both ends between two spaced frame plates, has been suggested in the prior art, such as U.S. Pat. No. 4,079,582—Tamuru et al. issued March 31, 1978. In the Tamaru patent, the stepping motor drives the gear train through a frictionally coupled toothed claw.

A gear train mounted on overhung arbors rotating in a single journal is less stable than one mounted between two frame plates and is subject to wobble or misalignment unless measures are taken to provide a rigid journal mounting. However, a great advantage of an overhung gear train is that it lends itself to automated assembly of the timepiece from one side of the frame.

Accordingly, one object of the present invention is to provide an improved overhung gear train assembly for a stepping motor timepiece.

Another object of the invention is to provide an improved arrangement for a stepping motor timepiece which facilitates automated assembly processes.

DRAWING

The invention, both as to organization and method of practice, together with further objects and advantages thereof, will best be understood by reference to the following description, taken in connection with the accompanying drawings, in which:

FIG. 1 is developed elevation drawing, partly in section, illustrating the gear train and portions of the stepping motor, and FIG. 2 is a simplified plan view of the timepiece looking from the back side. The developed view of FIG. 1 is taken along the line I—I of FIG. 2.

SUMMARY OF THE INVENTION

Briefly stated, the invention is practiced by providing an electronic timepiece having means for generating a time-based electrical driving signal and a stepping motor driven by the signal, a frame member carrying the stepping motor and having at least one bore for an arbor wherein the bore defines two spaced journal bearings of lesser and greater diameters, a rotatable arbor disposed in the bore carrying a center wheel and an hour wheel attached to minute hand and hour hand respectively, and an intermediate arbor having minute pinion and minute wheel directly driving the hour wheel and center wheel respectively from the stepping motor.

DESCRIPTION OF THE PREFERRED EMBODIMENTS

Figure 1:
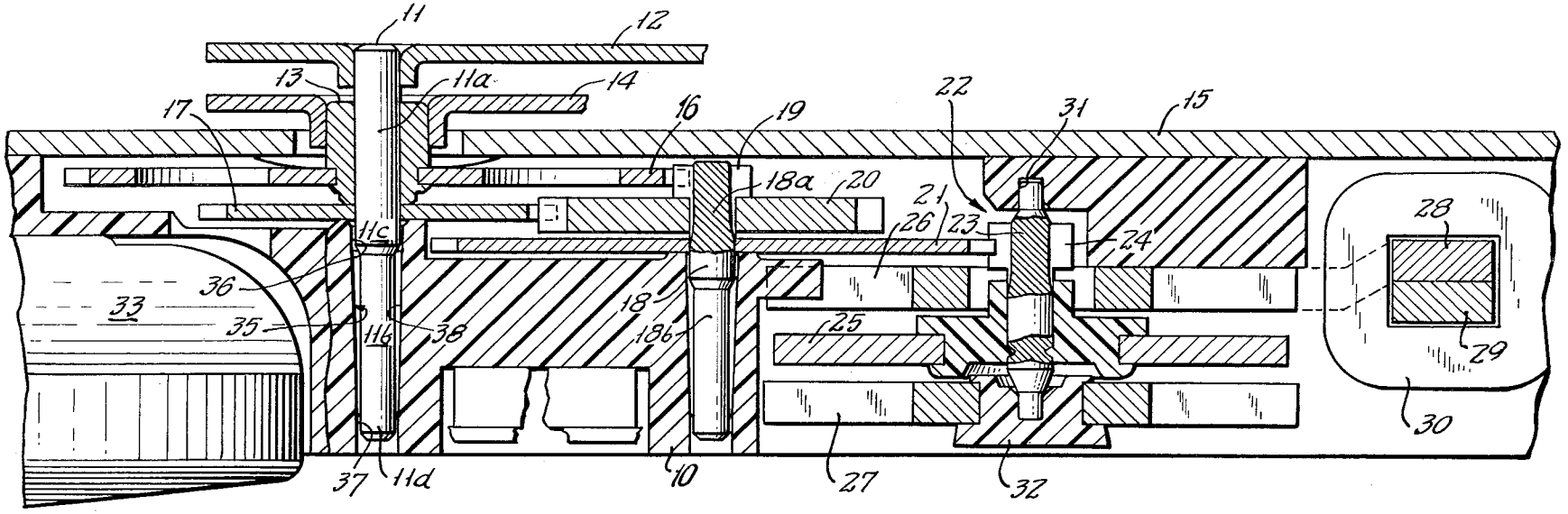

Referring first to FIG. 1 of the drawing, a portion of an electronic timepiece is shown in cross-sectional elevation view with the case removed so that only the portions of the movement are illustrated which are pertinent to the present invention. The timepiece includes a plastic frame member 10 rotatably mounting a main arbor 11 carrying a minute hand 12. The arbor has a coaxially disposed bushing 13 rotatable thereon carrying an hour hand 14. Hands 12 and 14 are outwardly disposed of a watch dial 15. Beneath the dial, an hour wheel 16 is fixed to the bushing 13 and a coaxial center wheel 17 is fixed to arbor 11.

Also rotatably disposed in the frame is a second or intermediate arbor 18 having a minute pinion 19, a minute wheel 20, and an intermediate wheel 21 all fixed thereto.

The aforementioned wheels and pinions 16, 17, 19, 20 and 21 all comprise a gear train which is driven by a stepping motor shown generally at 22. The stepping motor includes a rotor 23 having a pinion 24 meshing with intermediate wheel 21 and a permanently magnetized disc 25 rotatable step-by-step between upper and lower stator core pieces 26 and 27 respectively. The stator members form extensions of magnetically permeable core pieces overlapped within a coil 30. The rotor pinion is journaled at one end in a bore 31 in the frame and at the other end in a plastic bearing insert 32 held by the lower stator 27.

Figure 2:
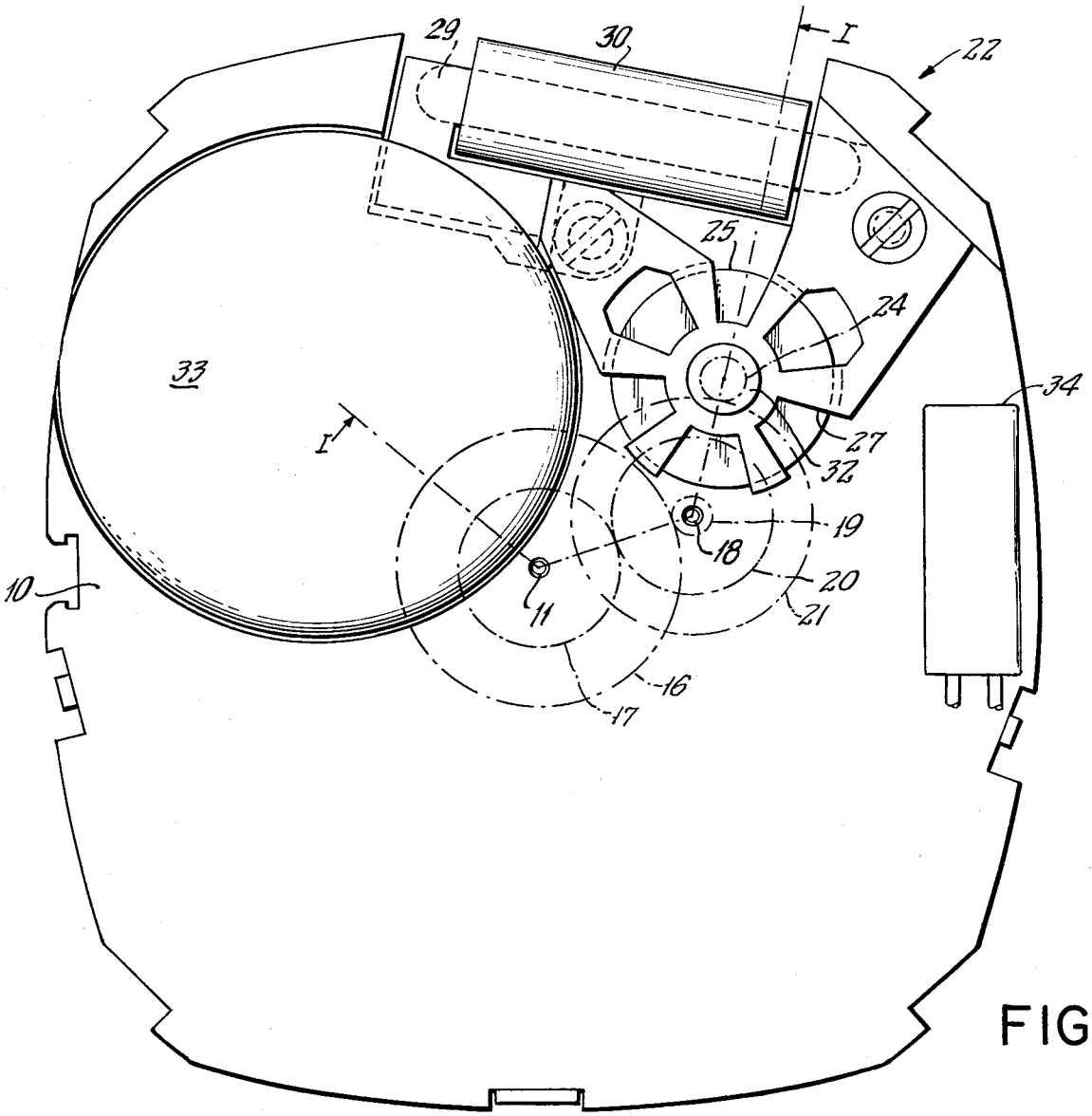

Referring to the plan view of FIG. 2 of the drawing, the timepiece movement is illustrated in very schematic form to illustrate the placement of the stepping motor and the gear train. The frame 10 includes recesses for an energy cell 33 which supplies electrical power to drive the stepping motor 22. A stepping motor drive circuit, preferably an integrated circuit, associated with a quartz oscillator provides a time-based series of electrical pulses by means well known but not material to the present invention. A quartz crystal placement is indicated at 34.

The stepping motor is preferably of the type illustrated in U.S. Pat. No. 4,079,279 issued Mar. 14, 1978 to Oudet et. al. which is incorporated herein by reference.

The gear train is illustrated by the phantom lines to include an hour wheel 16, coaxial with a center wheel 17, causing rotation of the hour hand and minute hand as previously described. The hour wheel meshes with and is driven by the minute pinion 19. The center wheel 17 meshes with and is driven by the minute wheel 20. The intermediate wheel 21 is disposed on the same arbor as minute pinion 19 and minute wheel 20, providing an intermediate gear and pinion assembly. The intermediate wheel 21 is directly driven by the pinion 24 of the rotor of the stepping motor.

Referring back to FIG. 1 of the drawing, the two gear assemblies carried by arbors 11 and 18 are of the "overhung" type, meaning that the gears are carried on one extending end of the arbor and the other end of the arbor is rotatably journaled on one end only in a single member. This is in contrast to an arbor which is mounted between two spaced plates each having a bearing holding opposite ends of the arbor.

In accordance with the present invention, the arbors 11 and 18 have overhung portions 11*a* and 18*a* respectively carrying the gears and have journal portions 11*b* and 18*b* respectively extending into the frame. Each of the arbors is similarly journaled, and the following explanation of the rotatable support for the main arbor 11 will suffice also for the intermediate arbor 18.

The frame defines a bore 35 with a cyclindrical bearing bore 36 of larger diameter and a cylindrical bearing bore 37 of smaller diameter spaced and connected by a tapered surface 38. The journaled portion 11*b* of the arbor is provided with a first journal 11*c* of larger diameter and a second journal 11*d* of smaller diameter. By means of the foregoing construction, the main arbor with its gear assembly can be inserted by automated equipment by simply placing the journal portion 11*b* in the bore 35, with the journal portions of larger and smaller diameter properly fitting in the respective bores.

In the preferred embodiment shown, the gear train is assembled from the upper side of the frame 10. Intermediate gear and pinion assembly of members 19, 20 and 21 mounted on arbor 18 are dropped into the bore as indicated. The other subassembly comprises gear members 16 and 17 mounted on arbor 11 with the dial 15 attached and the hands 12 and 14 already affixed. The subassembly is simply dropped into place by inserting the journal portion 11*b* of the main arbor in the bore 35 and causing the gears to mesh. The stepping motor 22 may also be inserted as an assembly from the other side of the frame as should be apparent from the figure.

OPERATION

In operation, the time-based electrical driving signals from the circuit of the timepiece periodically advances the stepping motor rotor which drives the intermediate wheel 21. This causes the gears 19 and 20 to drive the wheels 16 and 17 at the proper relative speeds. In the arrangement shown, the stepping motor performs a 60° step each minute to perform 10 revolutions per hour. The gear ratio between pinion 24 and intermediate wheel 21 is 1:10 so that the intermediate gear and pinion assembly is driven at one revolution per hour. The minute wheel and the center wheel each have the same number of teeth so that the main arbor and minute hand is driven at one revolution per hour. The gear ratio between the minute pinion and hour wheel is 1:12, so that the bushing 13 and hour hand are driven at 1/12 revolution per hour.

The foregoing arrangement provides a very compact gear train with a minimum of parts and the overhung subassemblies permit automatic assembly. The special journal bores provide support for the arbors facilitating easy subassembly and reducing wobble or misalignment of gears because of the very rigid support afforded by the spaced bearing surfaces within the bores.

While there has been described what is herein considered to be the preferred embodiment of the invention, other modifications will occur to those skilled in the art, and it is desired to secure in the appended claims all such modifications as fall within the true spirit and scope of the invention.

What is claimed is:

1. An electronic stepping motor timepiece comprising:

means generating time-based electrical driving signals, a stepping motor having a rotor and pinion adapted to periodically rotate in response to said signals, a frame carrying said stepping motor and having at least one bore defining spaced larger and smaller diameter journal bearings, within said bore, at least one arbor disposed in said bore having a journal portion with spaced larger and smaller diameter journals, and an overhung portion extending from the frame, a center wheel attached to said overhung arbor portion and a bushing rotatably disposed on the arbor having an hour wheel attached thereto, an intermediate gear and pinion assembly rotatably mounted on the frame and driving the center wheel and hour wheel, said stepping motor pinion directly driving said gear and pinion assembly.

2. An electronic stepping motor timepiece comprising:

means generating time-based electrical driving signals, a stepping motor having a rotor and pinion adapted to periodically rotate in response to said signals, a frame carrying said stepping motor and having first and second spaced bores, said bores defining journal bearings, a first overhung arbor disposed in the first bore having a center wheel thereon, a second overhung arbor disposed in the second bore having a minute wheel fixed thereon driving the center wheel and also having a minute pinion fixed thereon, a bushing rotatably journaled on the first arbor having thereon an hour wheel driven by said minute pinion, a separate intermediate wheel disposed on and affixed to the second arbor and driven directly by said stepping motor pinion.

3. The combination according to claim 2 wherein each of said bores defines spaced larger and smaller diameter journal bearings, and wherein said arbors each include a journal portion with spaced larger and smaller diameter journals adapted to rotate in said spaced larger and smaller diameter journal bearings.

4. The combination according to claim 3 wherein said bores comprise a tapered hole connecting said spaced bearings.

5. The combination according to claim 4 wherein said stepping motor comprises a permanently magnetized rotor disposed between two stator members having core pieces cooperating with an electric coil.

* * * * *